US007699642B2

(12) United States Patent
Yamashita et al.

(10) Patent No.: US 7,699,642 B2
(45) Date of Patent: Apr. 20, 2010

(54) CONNECTOR HAVING A LOCKING MECHANISM EXCELLENT IN OPERABILITY

(75) Inventors: Masaki Yamashita, Tokyo (JP); Takeshi Shindo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/316,882

(22) Filed: Dec. 17, 2008

(65) Prior Publication Data

US 2009/0170357 A1 Jul. 2, 2009

(30) Foreign Application Priority Data

Dec. 26, 2007 (JP) ..... 2007-334676

(51) Int. Cl.
*H01R 13/627* (2006.01)

(52) U.S. Cl. ..... 439/352

(58) Field of Classification Search ..... 439/350, 439/352

See application file for complete search history.

(56) References Cited

U.S. PATENT DOCUMENTS 5,580,182 A * 12/1996 Lin ..... 439/352
5,954,531 A * 9/1999 Jennings et al. ..... 439/352
6,113,413 A * 9/2000 Cronin et al. ..... 439/352
6,616,473 B2 9/2003 Kamata et al.
6,860,748 B2 * 3/2005 Ohtani et al. ..... 439/352
7,150,634 B2 12/2006 Kamata et al.

FOREIGN PATENT DOCUMENTS

| | | |
|---|---|---|
| JP | 10-302893 | 11/1998 |
| JP | 2001-217038 | 8/2001 |
| JP | 2002-190351 | 7/2002 |
| JP | 2003-257548 | 9/2003 |
| JP | 2005-353391 | 12/2005 |
| JP | 2006-012647 | 1/2006 |

OTHER PUBLICATIONS

Japanese Office Action dated Nov. 18, 2009.

* cited by examiner

*Primary Examiner*—Tho D Ta
(74) *Attorney, Agent, or Firm*—Collard & Roe, P.C.

(57) ABSTRACT

In a connector including a connector body capable of being connected to or disconnected from a connecting object in a first direction, the connector body has, in a second direction perpendicular to the first direction, a particular dimension greater than a dimension thereof in a third direction perpendicular to the first and second directions. A locking portion is coupled to the connector body for locking the connecting object. The the locking portion is adapted to release locking of the connecting object with movement thereof in the second direction. An operating portion is coupled to the connector body and adapted to engage with the locking portion. The operating portion is adapted to move the locking portion in the second direction according to movement thereof in the third direction.

8 Claims, 4 Drawing Sheets

CONNECTOR HAVING A LOCKING MECHANISM EXCELLENT IN OPERABILITY

This application is based upon and claims the benefit of priority from Japanese patent application No. 2007-334676, filed on Dec. 26, 2007, the disclosure of which is incorporated herein in its entirety by reference.

1. Technical Field

This invention relates to a connector having a function of locking a state of being connected to a connecting object.

2. Background Art

This type of connector is disclosed, for example, in Japanese Unexamined Patent Application Publication (JP-A) No. 2002-190351 entitled "Electrical Connector with a Locking Mechanism". This electrical connector with the locking mechanism includes a plug connector that is fittable/removable in a first direction (fitting/removal direction) with respect to a receptacle connector as a connecting object. In the plug connector, the dimension in a second direction (width direction) perpendicular to the fitting/removal direction is designed to be greater than that in a third direction (thickness direction) perpendicular to the fitting/removal direction and the width direction. The plug connector includes a number of conductive contacts arranged in the width direction.

The plug connector has a pair of locking pieces movable in the thickness direction for locking while it is connected to the receptacle connector, and a pair of lock release arms for releasing the locking by the locking pieces. The locking pieces are provided at both ends, in the width direction, of the plug connector, respectively. The lock release arms are also provided at both ends, in the width direction, of the plug connector, respectively.

For removing the plug connector from the receptacle connector, the pair of lock release arms are sandwiched from both sides by fingers so as to be moved toward each other in the width direction. Following the movement of the lock release arms, the locking pieces move in the thickness direction to release the locking of the receptacle connector. As a result, the plug connector can be removed from the receptacle connector.

SUMMARY OF THE INVENTION

However, for releasing the locking, it is necessary to sandwich the pair of lock release arms by fingers from both sides in the width direction in which the dimension of the connector is large, which is inconvenient in operability. Particularly, in the case of a connector with a large number of contacts arranged in the width direction, since the dimension of the connector in the width direction is large, it is difficult to sandwich a pair of lock release arms by fingers from both sides in the width direction and thus there is a problem in operability.

Further, if the connector is pinched in the thickness direction, the locking is released relatively easily. That is, the strength of the locking by the locking pieces movable in the thickness direction of the connector is weak. On the other hand, if the locking strength is excessively improved, it becomes difficult to release the locking.

It is therefore an exemplary object of this invention to provide a connector that can maintain a required locking strength and yet allows locking to be easily released.

Other objects of the present invention will become clear as the description proceeds.

According to an exemplary aspect of the present invention, there is provided a connector which comprises a connector body which is capable of being connected to or disconnected from a connecting object in a first direction, wherein the connector body has a particular dimension in a second direction perpendicular to the first direction, and the particular dimension is greater than a dimension of the connector body in a third direction perpendicular to the first and second directions, a locking portion which is coupled to the connector body for locking the connecting object, wherein the locking portion is adapted to release locking of the connecting object with movement thereof in the second direction, and an operating portion which is coupled to the connector body and adapted to engage with the locking portion, wherein the operating portion is adapted to move the locking portion in the second direction according to movement thereof in the third direction.

DESCRIPTION OF THE EXEMPLARY EMBODIMENT

Figure 1:
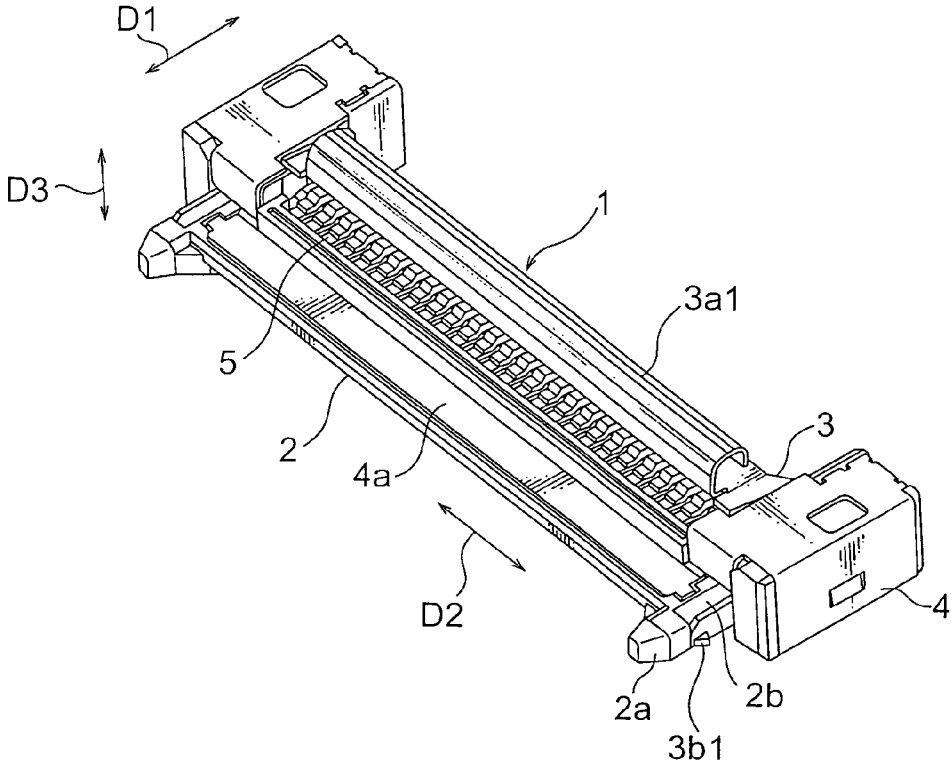
FIG. 1 is a perspective view of a connector according to an exemplary embodiment of this invention.

Referring to FIG. 1, the overall structure of a connector according to an exemplary embodiment of this invention will be described. The illustrated connector is a connector to be connected with a cable and thus will be referred to as a "cable-side connector" hereinbelow.

The cable-side connector is denoted by reference symbol 10 and comprises a connector body 1 that can be fitted (namely, connected) to or removed (namely, disconnected) from a connecting object (not illustrated) in a first direction (fitting/removal direction) D1, and a locking member 3 coupled to the connector body 1.

The connector body 1 comprises an insulating housing 2 and a number of conductive contacts 5 held by the housing 2. The contacts 5 are arranged in a single row at a predetermined pitch in a second direction (width direction) D2 perpendicular to the first direction D1. A direction perpendicular to the first and second directions D1 and D2 will be referred to as a third direction (thickness direction) D3.

The housing 2 has a rectangular parallelepiped shape defining an external form of the connector body 1. The dimension, in the second direction D2, of the housing 2 is designed to be greater than either of those in the first and third directions D1 and D3.

Figure 2A:
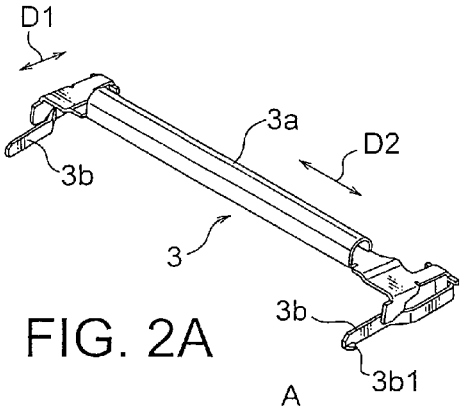
FIG. 2A is a perspective view of a locking member included in the connector of FIG. 1.
Figure 2D:
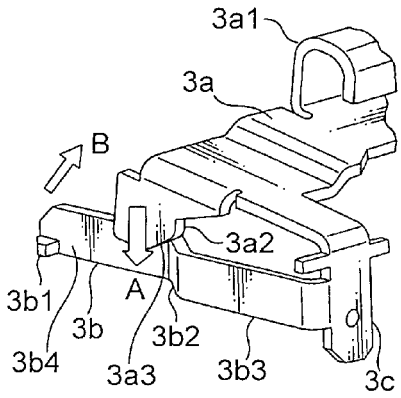
FIG. 2D is an enlarged perspective view of only a main portion of the locking member.
Figure 2C:
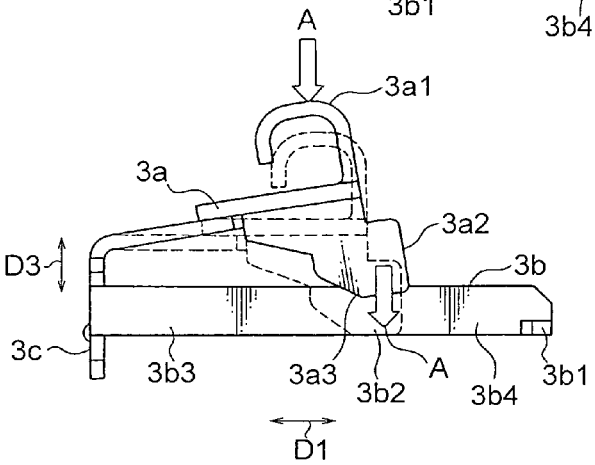
FIG. 2C is an enlarged side view of the locking member.
Figure 2B:
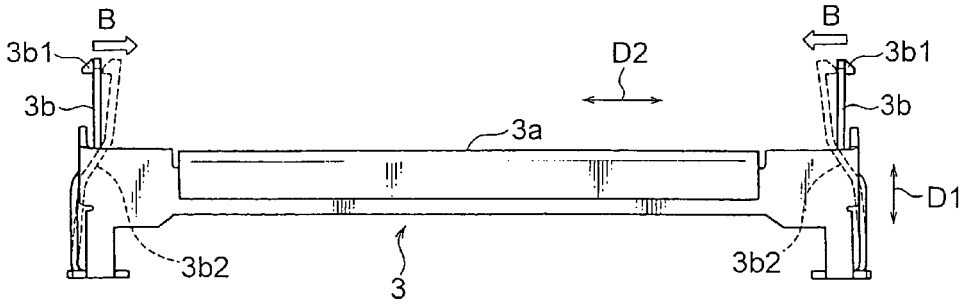
FIG. 2B is an enlarged plan view of the locking member.

Referring also to FIGS. 2A to 2C, the locking member 3 will be described.

The locking member 3 is laterally symmetrical and is integrally formed from a metal plate. The locking member 3 comprises an operating portion 3*a* having a generally U-shape in cross section and extending in the second direction D2 along the top portion of the connector body 1, a pair of locking portions 3*b* formed at both ends, in the second direction D2, of the operating portion 3*a*, respectively, and a pair of fixing portions 3*c* fixed to the housing 2.

The locking portions 3*b* serve to lock the connecting object or release the locking according to movement thereof in the second direction D2. Specifically, while locking the connecting object, the locking portions 3*b* are located at positions spaced apart from each other, i.e. the positions indicated by solid lines in FIG. 2B. On the other hand, when the locking portions 3*b* are inwardly pushed towards directions of arrows B to move to positions closer to each other, i.e. the positions indicated by broken lines in FIG. 2B, the locking of the connecting object is released.

The operating portion 3*a* is formed to be movable in the third direction D3. As will be clear from a later description, following movement of the operating portion 3*a* in a direction of arrow A, the locking portions 3*b* move toward each other to release the locking of the connecting object.

Referring also to FIG. 2D, the relationship between the operating portion 3*a* and the locking portions 3*b* will be described in further detail.

A movable button 3*a*1 operable by an operator's finger is formed in the middle of the operating portion 3*a*. Further, abutting portions 3*a*2 are formed at both ends, in the second direction D2, of the operating portion 3*a*, respectively. When the button 3*a*1 is depressed in the direction of arrow A so as to be in a broken-line state as illustrated in FIG. 2C, the abutting portions 3*a*2 also move in the direction of arrow A in response thereto. Each abutting portion 3*a*2 has an inclined portion 3*a*3 inclined with respect to the third direction D3.

On the other hand, each locking portion 3*b* comprises an arrowhead-shaped engaging portion 3*b*1 for engagement with the connecting object in the first direction D1, a to-be-abutted portion 3*b*2 that engages with the abutting portion 3*a*2 when the abutting portion 3*a*2 moves in the third direction D3, and a first spring portion 3*b*3 extending from the fixing portion 3*c* and thus having one end supported by the connector body 1. The first spring portion 3*b*3 can be elastically displaced in a plane perpendicular to the third direction D3. The to-be-abutted portion 3*b*2 extends obliquely from the other end of the first spring portion 3*b*3. The engaging portion 3*b*1 is formed on a second spring portion 3*b*4 extending obliquely from the to-be-abutted portion 3*b*2. That is, the first spring portion 3*b*3, the to-be-abutted portion 3*b*2, and the second spring portion 3*b*4 extend so as to form a generally crank shape. When the abutting portion 3*a*2 moves in the third direction D3, the inclined portion 3*a*3 engages with the to-be-abutted portion 3*b*2 to thereby push the other end of the first spring portion 3*b*3 in the second direction D2. Incidentally, the second spring portion 3*b*4 may also be configured to be elastically deformable.

Figure 3:
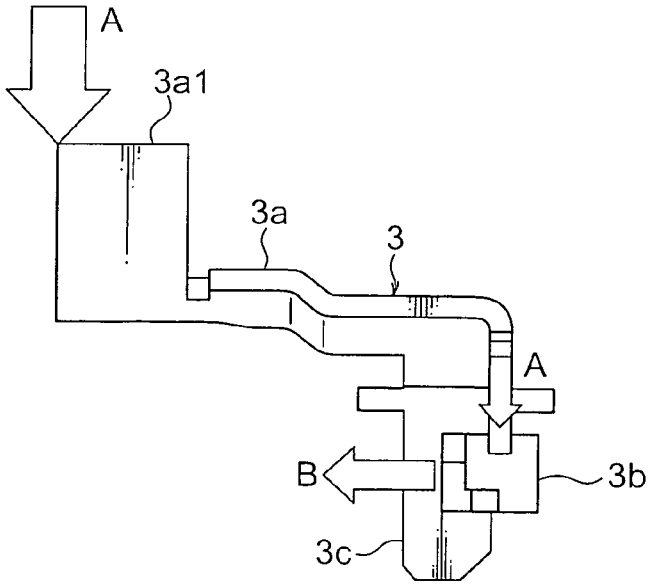
FIG. 3 is an explanatory diagram for explaining the operation of the locking member illustrated in FIGS. 2A to 2D.

Referring also to FIG. 3, the operation of the locking member 3 illustrated in FIGS. 2A to 2D will be described.

In the state where the cable-side connector 10 is connected to the connecting object, the button 3*a*1 is pushed in the direction of arrow A. Since the button 3*a*1 of the operating portion 3*a* is formed projecting, the operation is easy. Then, as illustrated in FIG. 2C, the operating portion 3*a* moves from a solid-line position to a broken-line position. In this event, since the inclined portions 3*a*3 of the abutting portions 3*a*2 push the to-be-abutted portions 3*b*2 of the locking portions 3*b*, the first spring portions 3*b*3 are elastically displaced. As a result, the locking portions 3*b* engaging with to-be-locked portions (not illustrated) of the connecting object are pushed in the directions of arrows B (lock release directions). Specifically, since the pair of engaging portions 3*b*1 respectively move inward in the directions of arrows B as illustrated in FIG. 2B, the engagement with the to-be-locked portions of the connecting object is released.

Referring back to FIG. 1, the description of the cable-side connector 10 will be supplemented. The housing 2 includes a pair of guide portions 2*a* that serve to guide fitting or removal of the cable-side connector 10 with respect to the connecting object. Each guide portion 2*a* has a receiving portion 2*b* in which the locking portion 3*b* is received. The housing 2 is covered with a metal shell 4. The shell 4 comprises a shell body 4*a* covering a fitting portion of the housing 2 and a pair of cover shell portions 4*b* covering both end portions of the housing 2.

Figure 4:
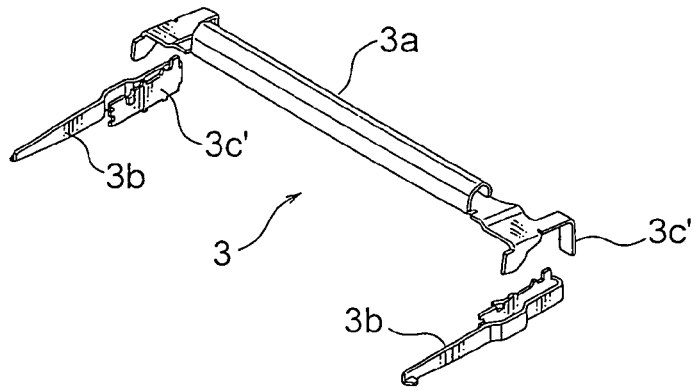
FIG. 4 is a perspective view illustrating a first modification of the locking member.

As illustrated in FIG. 4, an operating portion 3*a* and locking portions 3*b* may be formed as separate components. In this case, the operating portion 3*a* and the locking portions 3*b* are formed with fixing portions 3*c*', respectively, for fixing to a connector body 1.

Figure 5A:
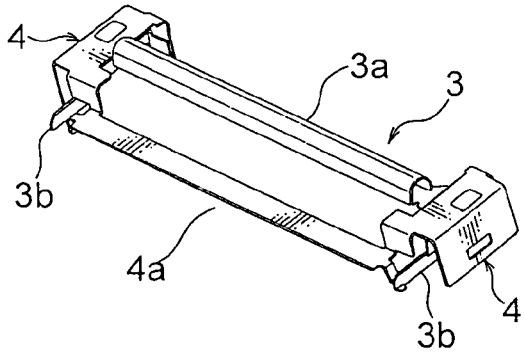
FIG. 5A is a perspective view illustrating a second modification of the locking member.
Figure 5B:
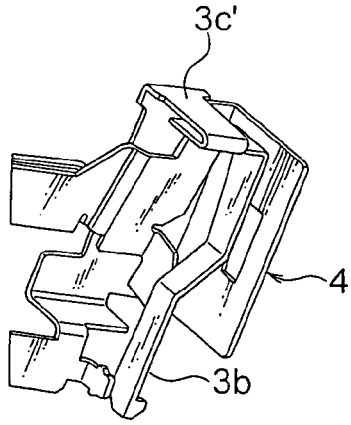
FIG. 5B is an enlarged perspective view of only part of the modification illustrated in FIG. 5A.

On the other hand, as illustrated in FIGS. 5A and 5B, an operating portion 3*a* and locking portions 3*b* may be integrally formed with a shell 4.

Note that the locking portion 3*b* may be formed at at least one of both ends, in the second direction D2, of the housing 2.

Now, referring also to FIGS. 6A to 6C, a description will be given of a case where the cable-side connector 10 is connected to a board-side connector 11 as a connection object.

A flat cable 12 is connected to the cable-side connector 10. On the other hand, the board-side connector 11 is fixedly mounted on a board 13.

Figure 6A:
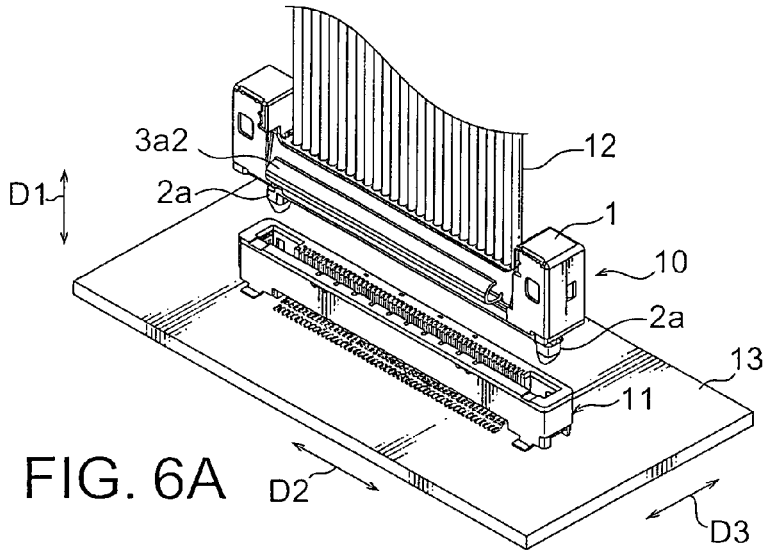
FIG. 6A is a perspective view illustrating a state before the connector of FIG. 1 is connected to a board-side connector, for the purpose of explaining a state of use of the connector of FIG. 1.
Figure 6B:
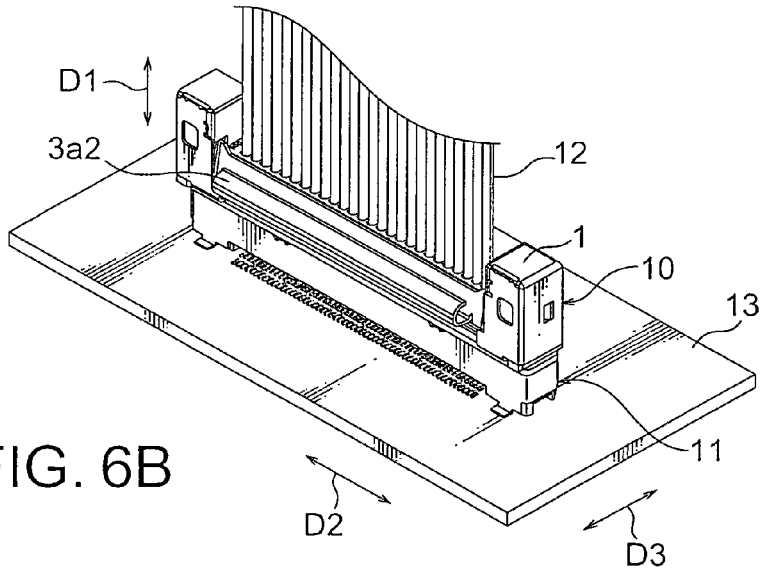
FIG. 6B is a perspective view, for the same purpose, illustrating a state where the connector of FIG. 1 is connected to the board-side connector.
Figure 6C:
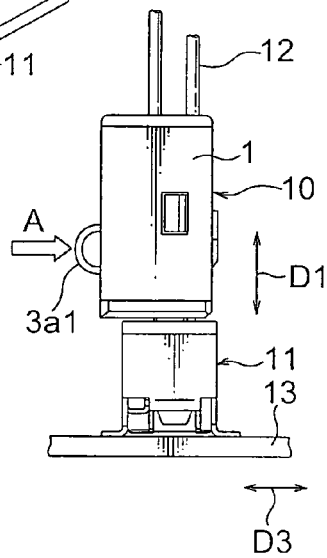
FIG. 6C is an enlarged side view, for the same purpose, illustrating a state where the connector of FIG. 1 is connected to the board-side connector.

Positioning between the cable-side connector 10 and the board-side connector 11 is carried out as illustrated in FIG. 6A and, using the guide portions 2*a*, the cable-side connector 10 is caused to approach the board-side connector 11. As a result, as illustrated in FIGS. 6B and 6C, the cable-side connector 10 and the board-side connector 11 are fitted together so that electrical connection therebetween is obtained. Simultaneously, the locking portions 3*b* engage with the to-be-locked portions of the connecting object as described above and, therefore, the cable-side connector 10 is locked to the board-side connector 11 and thus is also mechanically connected thereto.

In this state, if the button 3*a*1 is pushed in the direction of arrow A, the locking portions 3*b* engaging with the to-be-locked portions of the connecting object are pushed in the lock release directions so that the engagement with the to-be-locked portions of the connecting object is released as described above.

Various exemplary embodiments of this invention will be enumerated in the following items 1-10.

1. A connector (10) comprising:

a connector body (1) which is capable of being connected to or disconnected from a connecting object (11) in a first direction (D1), wherein the connector body has a particular dimension in a second direction (D2) perpendicular to the first direction, and the particular dimension is greater than a dimension of the connector body in a third direction (D3) perpendicular to the first and second directions;

a locking portion (3*b*) which is coupled to the connector body (1) for locking the connecting object (11), wherein the locking portion is adapted to release locking of the connecting object with movement thereof in the second direction (D2); and an operating portion (3*a*) which is coupled to the connector body (1) and adapted to engage with the locking portion (3*b*), wherein the operating portion is adapted to move the locking portion in the second direction (D2) according to movement thereof in the third direction (D3).

2. A connector (10) as described in item 1, wherein the connector body (1) comprises:

at least one contact (5) which is conductive; and a housing (2) which holds the contact, wherein the housing (2) has a rectangular parallelepiped shape in which a dimension in the second direction (D2) is greater than that in the first direction (D1) and that in the third direction (D3).

3. A connector (10) as described in item 2, wherein the locking portion (3*b*) is provided at at least one of both ends, in the second direction (D2), of the housing (2).

4. A connector (10) as described in any one of items 1-3, wherein each of the locking portion (3*b*) and the operating portion (3*a*) is a part of an integrally formed locking member.

5. A connector (10) as described in item 4, wherein the locking member (3*b*) integrally includes a fixing portion (3*c*) which is fixed to the housing (2).

6. A connector (10) as described in any one of items 1-5, wherein the locking portion (3*b*) and the operating portion (3*a*) are formed as separate components.

7. A connector (10) as described in any one of items 1-6, wherein the operating portion (3*a*) comprises an abutting portion (3*a*2) which is movable in the third direction (D3), and the locking portion (3*b*) comprises:

a spring portion (3*b*3) which has one end supported by the connector body, wherein the spring portion is capable of being elastically displaced in a plane perpendicular to the third direction (D3);

a to-be-abutted portion (3*b*2) which is connected to another end of the spring portion (3*b*3) and is adapted to engage with the abutting portion (3*a*2) when the abutting portion moves in the third direction (D3), thereby causing the spring portion to be elastically displaced; and an engaging portion (3*b*1) which is connected to the other end of the spring portion (3*b*3) for engagement with the connecting object (11) in the first direction (D1).

8. A connector (10) as described in item 7, wherein the abutting portion (3*a*2) comprises an inclined portion (3*a*3) which is inclined with respect to the third direction (D3), and, when the abutting portion moves in the third direction, the inclined portion engages with the to-be-abutted portion (3*b*2) to thereby push the other end of the spring portion (3*b*3) in the second direction (D2).

9. A connector (10) as described in any one of items 1-8, wherein the housing (2) comprises a guide portion (2*a*) for guiding connection or disconnection of the connector (10) with respect to the connecting object (11), and the guide portion comprises a receiving portion (2*b*) in which the locking portion (3*b*) is received.

10. A connector (10) as described in any one of items 1-9, further comprising a shell (4) covering the housing (2), wherein the locking portion (3*b*), the operating portion (3*a*), and the shell are integrally formed.

As is clear from the foregoing description, the following effects can be expected by the cable-side connector of FIG. 1.

1. Since the fitted state with the connecting object is released by operating the operating portion in the thickness direction of the housing, the operation is easy.

2. When releasing the fitted state with the connecting object, the locking strength is hardly affected even if the connector is pinched in the thickness direction of the housing, and further, the locking can be easily released.

3. The structure is simple and the number of components is small.

4. Since the connector assembly process is simple, the workability is improved.

What is claimed is:

1. A connector comprising:

a connector body which is capable of being connected to or disconnected from a connecting object in a first direction, wherein the connector body has a particular dimension in a second direction perpendicular to the first direction, and the particular dimension is greater than a dimension of the connector body in a third direction perpendicular to the first and second directions;

a locking portion which is coupled to the connector body for locking the connecting object, wherein the locking portion is adapted to release locking of the connecting object with movement thereof in the second direction; and an operating portion which is coupled to the connector body and adapted to engage with the locking portion, wherein the operating portion is adapted to move the locking portion in the second direction according to movement thereof in the third direction, wherein the operating portion comprises an abutting portion which is movable in the third direction and comprises an inclined portion inclined with respect to the third direction, wherein the locking portion comprises:

a spring portion which has one end supported by the connector body, the spring portion being elastically deformable in a plane perpendicular to the third direction;

a to-be-abutted portion which is connected to another end of the spring portion; and an engaging portion which is connected to the other end of the spring portion for being engaged with the connecting object in the first direction, and wherein, when the abutting portion moves in the third direction, the inclined portion engages with the to-be-abutted portion to thereby push the other end of the spring portion in the second direction. so that the engaging portion rotatably moves with respect to the one end of the spring portion with an elastic deformation of the spring portion in a plane perpendicular to the third direction.

2. The connector according to claim 1, wherein the locking portion and the operating portion are formed as separate components.

3. The connector according to claim 1, wherein the housing comprises a guide portion for guiding connection or disconnection of the connector with respect to the connecting object, and the guide portion comprises a receiving portion in which the locking portion is received.

4. The connector according to claim 1, further comprising a shell covering the housing, wherein the locking portion, the operating portion, and the shell are integrally formed.

5. The connector according to claim 1, wherein the connector body comprises:

at least one contact which is conductive; and a housing which holds the contact, wherein the housing has a rectangular parallelepiped shape in which a dimension in the second direction is greater than that in the first direction and that in the third direction.

6. The connector according to claim 5, wherein the locking portion is provided at at least one of both ends, in the second direction, of the housing.

7. The connector according to claim 1, wherein each of the locking portion and the operating portion is a part of an integrally formed locking member.

8. The connector according to claim 7, wherein the locking member integrally includes a fixing portion which is fixed to the housing.

* * * * *